US006980108B1

(12) United States Patent
Gebbia et al.

(10) Patent No.: US 6,980,108 B1
(45) Date of Patent: Dec. 27, 2005

(54) OPTICAL FIBER CABLE BASED INTRUSION DETECTION SYSTEM

(75) Inventors: Woods Gebbia, Sauquoit, NY (US); Richard Borowiec, Utica, NY (US); Benjamin Sitler, New Hartford, NY (US); Frank Giotto, New Hartford, NY (US); Ray Wertz, New York Mills, NY (US); Justin Lee Stevens, New York Mills, NY (US); Dan Convertino Convertino, Yorkville, NY (US); Murray J. S. Kirshtrin, New Hartford, NY (US)

(73) Assignee: Fiber Instrument Sales, Oriskany, NY (US)

( * ) Notice: Subject to any disclaimer, the term of this patent is extended or adjusted under 35 U.S.C. 154(b) by 330 days.

(21) Appl. No.: 10/141,402

(22) Filed: May 9, 2002

(51) Int. Cl.[7] ..... G08B 13/00

(52) U.S. Cl. ..... 340/555; 340/541; 340/556; 340/557; 340/564; 356/73.1; 356/450; 359/196; 359/577; 385/140

(58) Field of Search ..... 340/555, 556, 340/557, 564, 565, 541; 359/111, 173, 196, 577; 385/12, 13, 28, 115, 120, 140; 356/450, 73.1

(56) References Cited

U.S. PATENT DOCUMENTS 4,314,741 A * 2/1982 Deminet et al. ..... 385/126
4,399,430 A 8/1983 Kitchen
4,590,462 A * 5/1986 Moorehead ..... 340/605
4,777,476 A 10/1988 Dank
4,829,286 A 5/1989 Zvi
5,055,827 A 10/1991 Philipp
5,093,568 A * 3/1992 Maycock ..... 250/227.14
5,194,847 A 3/1993 Taylor
5,220,160 A * 6/1993 Sargoytchev ..... 250/227.16
5,243,670 A * 9/1993 Boncel ..... 385/13
5,434,557 A * 7/1995 Alizi ..... 340/555
5,578,990 A * 11/1996 Sanford, Jr. et al. ..... 340/541
5,705,984 A 1/1998 Wilson
5,757,988 A 5/1998 Lindow
6,002,501 A 12/1999 Smith
6,265,880 B1 7/2001 Born

* cited by examiner

*Primary Examiner*—Davetta W. Goins
(74) *Attorney, Agent, or Firm*—David Giglio

(57) ABSTRACT

There is provided an electronic security system for a perimeter structure that incorporates a fiber optic cable secured to the perimeter structure. Typically the perimeter structure is a fence. A light pulse is transmitted down the fiber optic cable. Mechanical attenuation devices disposed at various locations along the fiber optic cable are responsive to intrusion attempts. The mechanical attenuation devices produce measurable attenuations to the light pulse. Using backscattering light detection technology an intrusion attempt and the location of an intrusion is detected.

37 Claims, 13 Drawing Sheets

OPTICAL FIBER CABLE BASED INTRUSION DETECTION SYSTEM

FIELD OF THE INVENTION

The present invention relates to the field of electronic intrusion detection systems, and more particularly, to an optical fiber cable based electronic intrusion detection system.

BACKGROUND OF THE INVENTION

There are many existing perimeter security systems that use optical fiber as the sensing medium. Initially these systems were based on using the fiber as a wave-guide for a light signal and then detecting the light on the opposite end of the fiber. A loss of light would trigger an alarm. For example, U.S. Pat. No. 4,399,430 to Kitchen describes sending light through a system of detachable connections concluding with a device to measure light loss. If any of those connections were to be broken, the end light detector would receive less light and thus trigger an X alarm.

A more advanced optical fiber based intrusion detection system also implements optical fiber as the sensing medium, but instead of measuring for lost light it analyzes the backscattered light to determine the cause. More specifically, U.S. Pat. No. 5,194,847 to Taylor which is hereby incorporated by reference describes using an interferometer to analyze the patterns of light that are reflected as they are transmitted down an optical fiber. However, Taylor teaches burying optical fiber underground and measuring disturbances based on acoustic or pressure disturbances. Taylor's system is ill suited for intrusion sensing applications.

U.S. Pat. No. 5,705,984 to Wilson describes an intrusion detection system that is based on RF energy as opposed to light. Wilson also buries the cable underground and tests for RF changes caused by deformations in the cable. These deformations are attributable to the weight of an intruder on the cable.

Other inventions implement mechanical devices that are designed to convert a mechanical force into an attenuation of light intensity. Such devices exist but they rely on more than a force on the optical fiber cable itself. In the case of U.S. Pat. No. 4,829,286 to Zvi, a taut wire system is used to trigger a device that attenuates a separate optical fiber. In the case of U.S. Pat. No. 4,777,476 to Dank, a system of hollow tubes and disks translates a force on a fence post into an attenuation of light intensity. Again the direct force is applied to an external medium, the hollow fence post, and not the optical fiber cable. Further, U.S. Pat. No. 5,757,988 to Lindow a system is described that converts the presence of a liquid into an attenuation of light intensity through the optical fiber cable. Again an unrelated stimulus is used to cause a mechanical device to induce attenuation.

Some inventions that rely on breaking connections in the optical fiber cable include U.S. Pat. No. 6,002,501 to Smith that uses optical time domain reflectometer technology to determine an intrusion into barrels of hazardous waste. U.S. Pat. No. 5,055,827 to Phillip describes using optical time domain reflectometer technology to monitor equipment theft. Finally, U.S. Pat. No. 6,265,880 to Born uses optical time domain reflectometer technology to determine the location of chafing of a conduit.

OBJECTS AND SUMMARY OF THE PRESENT INVENTION

It is an object of the present invention to improve the field of electronic intrusion detection systems.

It is another object of the present invention to provide an electronic intrusion detection system that is based on measuring light through a fiber optic cable.

It is yet another object of the present invention to provide an electronic intrusion detection system that detects an intrusion and identifies the location of the intrusion.

It is still another object of the present invention to provide an electronic intrusion detection system that protects the integrity of a boundary structure such as a fence.

It is yet still another object of the present invention to provide an electronic intrusion detection system with the proper range of sensitivity to identify intrusions and intrusion attempts and minimize false alarms.

It is still yet another object of the present invention to provide an electronic intrusion system that is inexpensive to manufacture.

It is a further object of the present invention to provide an electronic intrusion system that is easy to install.

It is still a further object of the present invention to provide an electronic intrusion system that is low maintenance.

These and other objects are provided in accordance with the present invention in which there is an intrusion detection and location apparatus for an area secured by at least one perimeter fence. At least one fiber optic cable is secured to the perimeter fence. A light transmission means disposed at a first end of the at least one fiber optic cable transmits at least one light pulse from a light source through the at least one fiber optic cable. A light receiving means measures the intensity of light at a second end of the at least one fiber optic cable. Intrusion detecting means is responsive to the light receiving means. Light backscatter measuring means measures the intensity of backscattered light from the at least one pulse of transmitted light. Intrusion location means is responsive to the light backscatter measuring means.

In a one embodiment, the light measuring means includes a first detector that receives backscattered light from the second end. In a separate embodiment, the light measuring means includes a detector that receives transmitted light at the second end.

A mechanical attenuation device produces a measurable attenuation to the at least one light pulse through the fiber optic cable when the fiber optic cable is subjected to a displacement force. The apparatus includes a housing having a cable ingress opening and a cable egress opening, wherein the fiber optic cable is inserted through the housing through the ingress and egress openings. Securing means disposed within the housing secure a portion of the fiber optic cable relative to a predetermined position within the housing. A movable securing means disposed within the housing allow a second portion of the fiber optic cable to displace relative to the housing when the fiber optic cable is subject to the displacement force. A light signal attenuation producing means disposed within the housing is responsive to the displacement force and creates a microbend in the fiber optic cable when the displacement force is provided.

The movable securing means includes a sliding mechanism fixedly secured to said fiber optic cable. The sliding mechanism includes a lever being forced to a first position by a spring. The light signal attenuation means includes a spring loaded plunger that is released upon sufficient displacement of the sliding mechanism. When the spring loaded plunger is released into an attenuation well measurable attenuation occurs in the light pulse. A slack fiber well stores a sufficient amount of slack fiber optic cable so that the fiber optic cable does not suffer structural failure upon release of the spring loaded plunger.

In another embodiment the movable securing means includes a tensioner which allows the fiber optic cable to move in only one direction when a displacement force is applied to the fiber optic cable. The tensioner includes a compression spring that forces the fiber optic cable to be movably secured between the top of the tensioner and an interior wall of the housing. An attenuation well stores a length of slack fiber optic cable. The slack fiber optic cable is caused to become taut in the attenuation well when a displacement force is applied to said fiber optic cable. At least one mandrel is disposed in the attenuation well such that the fiber optic cable becomes taut against the at least one mandrel when a displacement force is applied to the fiber optic cable thereby causing a measurable attenuation in the light signal.

BRIEF DESCRIPTION OF THE DRAWINGS

The above and other objects of the present invention will be better understood by reading the following detailed description of the preferred embodiments of the invention, when considered in connection with the accompanying drawings, in which:

FIG. 2 shows a schematic diagram of a first embodiment of the intrusion detection system in accordance with the present invention;

DETAILED DESCRIPTION OF THE PRESENT INVENTION

Figure 1:
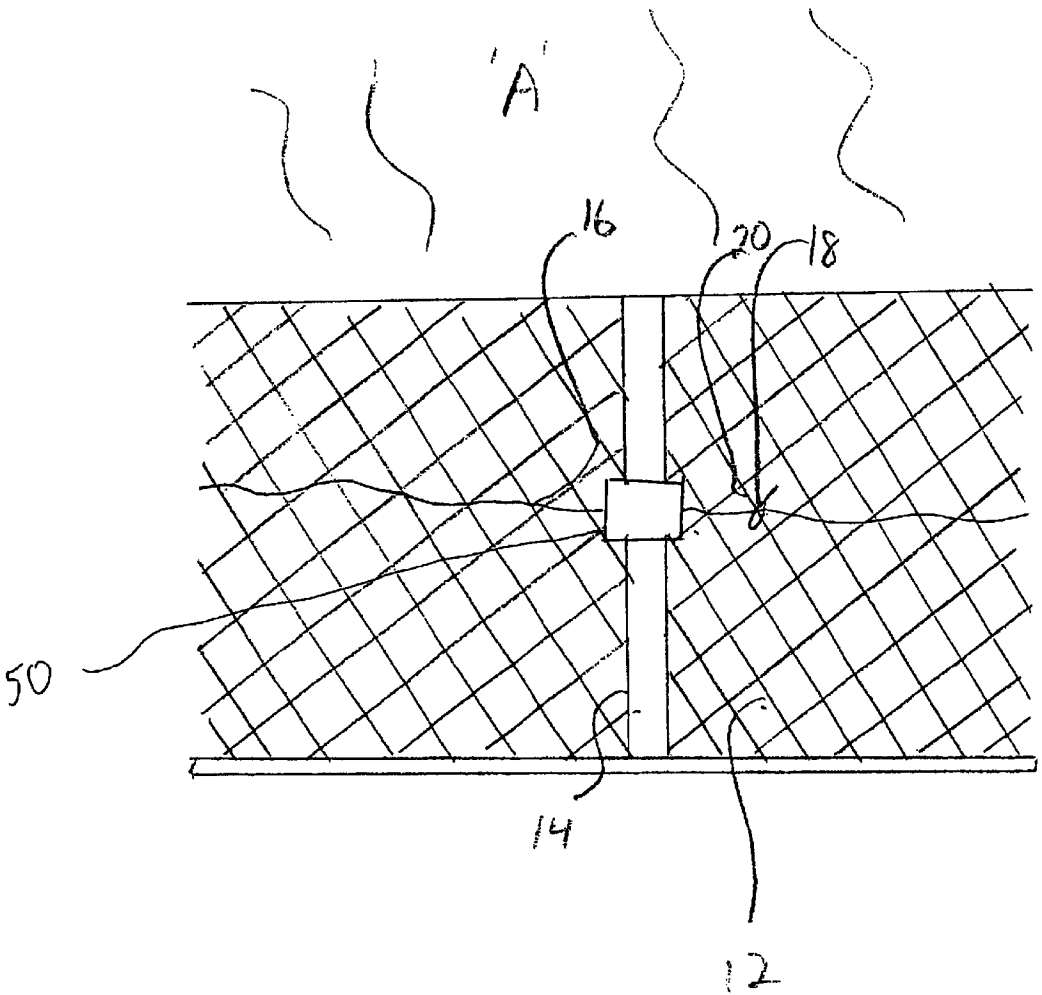
FIG. 1 shows a side elevation view of a portion of an area 'A' bounded by a portion of a fence having an intrusion detection system in accordance with the present invention.
Figure 1:
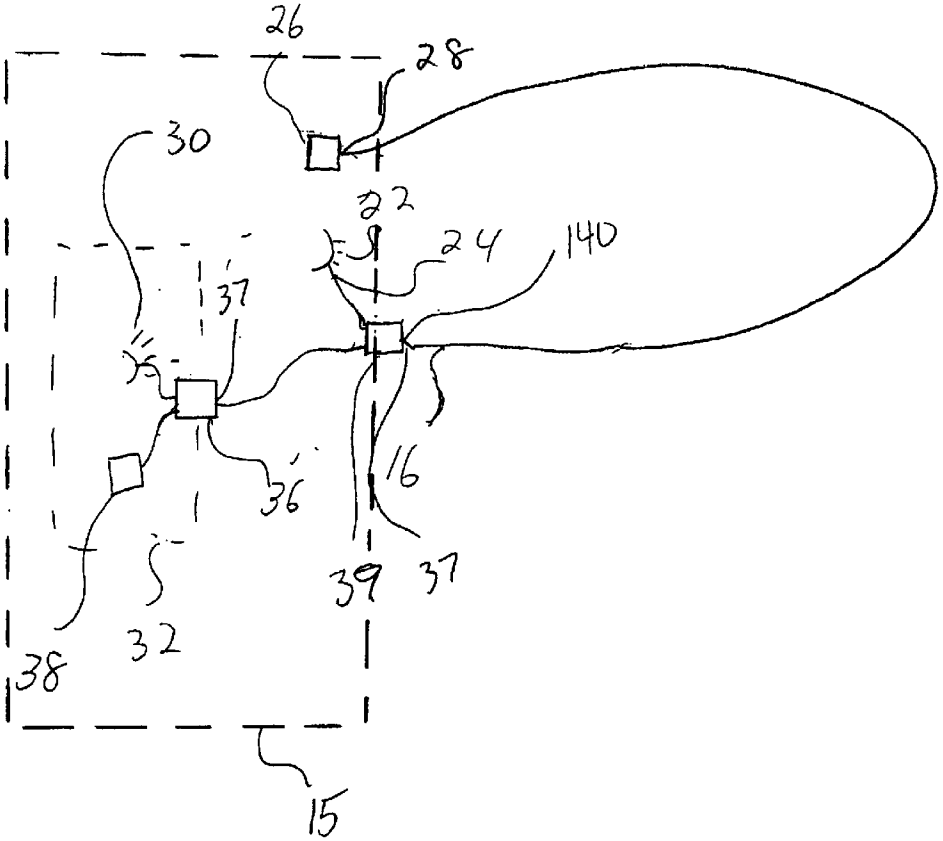

The invention will now be described in accordance with the Figs., in which FIG. 1 shows an area A bounded at certain perimeter locations by a fence 12. FIG. 1 shows the fence 12 as being a metallic chain link fence having multiple support posts 14. Other types of fences or boundary separators, such as wall structures etc. could also be equipped with the present invention to provide intrusion detection.

A fiber optic cable 16 is tightly secured to the fence 12 using any suitable fastening means. For our example, a tie-wrap 18 secures the fiber optic cable 16 to the fence links 20 at various locations. It is desirable to remove slack from the fiber optic cable 16 between the tie wraps 18.

Although FIG. 1 shows only one fiber optic cable 16 it will become apparent that a number of parallel or eccentrically spaced fiber optic cables would provide intrusion detection for different types of intrusion. For example, having one fiber optic cable 16 would be a cost effective solution for an intrusive detection aimed at detecting a vehicle attempting to crash through the fence 12.

However, where an intruder desires to gain entry into area A by scaling the fence 12, it is important to have a number of closely spaced fiber optic cables so that the intruder is forced to disturb one or more fiber optic cables.

In FIG. 1, the fiber optic cable 16 is tautly secured to the fence 12 so that a force on the fiber optic cable 16 causes a microbend in the fiberoptic cable resulting in an attenuation of a light signal. If the cable 16 were loosely secured to the fence 12, it may be possible to displace cable segments to gain illicit entry into area A without causing an attenuation to the light signal.

In a first embodiment of a control unit 15 of the present invention depicted in FIG. 2, a first light source emits light through one end 24 of the fiber optic cable 16. A first photodetector 26 disposed at a second end 28 of the fiber optic cable 16 receives the emitted light. The level or intensity of light received by the first photodetector 26 is compared to a base level, where the base level is the intensity that is received at the first photodetector 26 when the system is in normal operation with no corruption to the fiber optic cable 16.

When the intensity of light detected at the first photodetector 26 falls below the base level by a predetermined amount, internal circuitry triggers a second light source 30 inherent in an optical time domain reflectometer 32 ("OTDR") to transmit light through a coupler 36 and the fiber optic cable 16. If the frequency from the second light source 30 is the same as the frequency from the first light source 22 then the first light source 22 must shut down.

Using optical time domain reflectometer technology, which is known in the art, it is possible to determine an amount of backscattered light at each point along the fiber optic cable 16. A fiber optic cable 16 inherently contains an even distribution of impurities which forces a reflection of light back toward the light source. The OTDR 32 utilizes a second photodetector 38 that receives the backscattered light through the coupler 36.

In one embodiment, the OTDR 32 continuously samples the amount of backscattered light at each point along the fiber optic cable 16 and compares the backscattered light intensity at along the fiber optic cable 16 with a previous sample to determine where a sufficient change in backscattered light intensity has occurred. In another embodiment, the OTDR 32 is actuated by a detection of a loss in light intensity at the second end 28 of the fiber optic cable 16.

One term that will now be addressed is a microbend. A microbend is a bend in the fiber optic cable such that the radius of the bend causes a detectable attenuation in the intensity of the light signal that continues to pass through the fiber and also causes a detectable increase in the backscattered light intensity that is received by the photodetector 38 for that point along the fiber optic cable.

Therefore, a microbend in the fiber optic cable 16 results in a loss of light intensity at the second end 28 of the fiber optic cable 16. Further, the location of the microbend along the fiber optic cable 16 can be readily determined using the OTDR 32.

Figure 3:
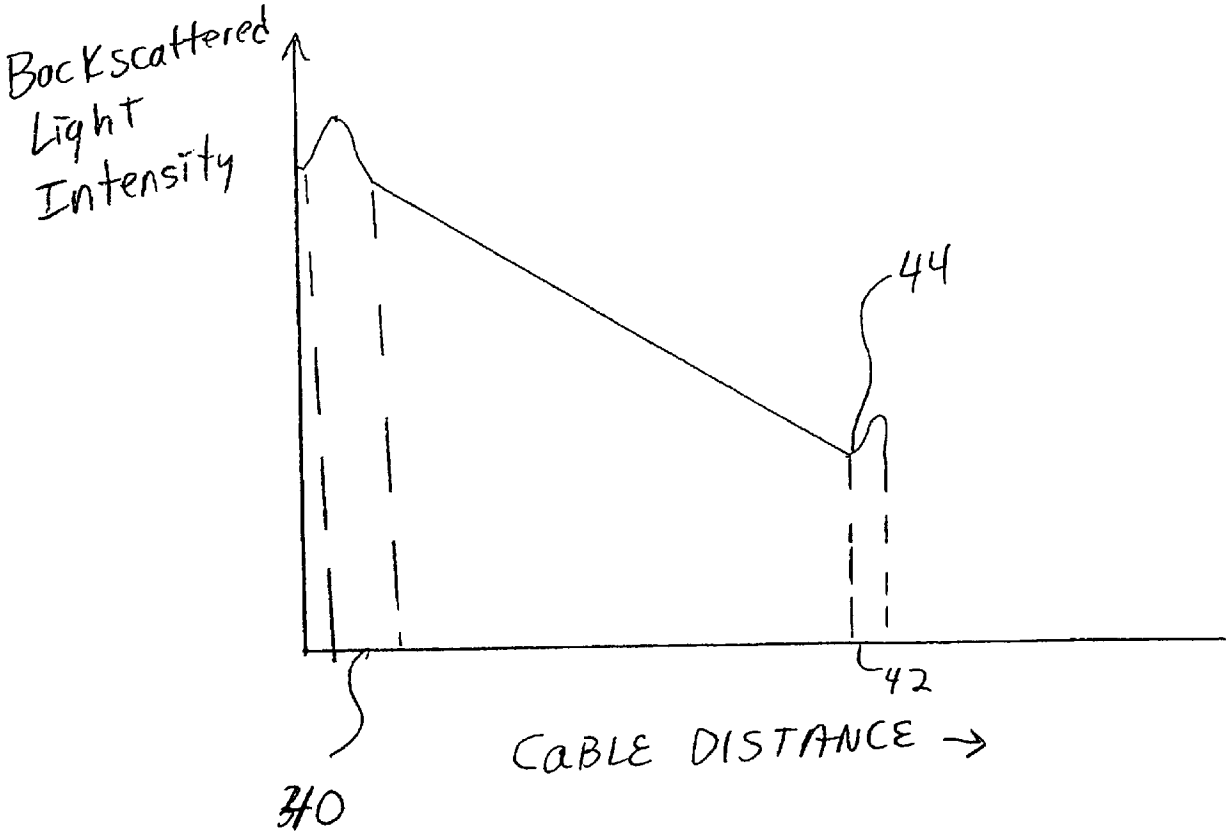
FIG. 3 is a graphic illustration of a typical back scattered light intensity versus cable length for a light pulse traveling down the intrusion detection system of FIG. 2.

With respect to the graph depicted in FIG. 3 the embodiment of FIG. 2 shall now be explained. The first light source 22 emits a light signal down the first end 24 of the fiber optic cable 16. When a loss of intensity is determined at the second end 28 of the fiber optic cable 16, as described above, the second light source 30 from the OTDR 32 emits light through the coupler 36 and down the fiber optic cable 16.

The backscattered light intensity received by the second photodetector 38 at each point along the fiber optic cable 16 is depicted in the graph of FIG. 3. Initially, the backscattered light intensity is higher because the reflections are close to the source. As the light moves down the cable the reflections are further away from the source and produce a lower intensity. When the light passes through the coupler 36 there is an initial surge in backscattered light intensity such that backscattered light cannot be detected for a certain distance along the cable. This distance is called the dead zone. This dead zone 40 is caused by the impurities associated with the coupler 36. To compensate for the dead zone 40, a length of fiber optic cable equivalent to the length of the dead zone 40 is spooled near the coupler 36 so that backscattered light can be detected along the entire useful length of the fiber optic cable 16.

Moving along the fiber optic cable 16 with respect to the graph of FIG. 3, a microbend in the fiber optic cable causes a second drop 42 in backscattered light that is detected by the OTDR 32. From this second drop 42, the location 44 of the microbend along the fiber optic cable is readily determined.

It should now be presupposed that an intrusion attempt causes a microbend in the fiber optic cable 16. Or as will be described later an intrusion attempt causes a mechanical attenuation device to produce a microbend in the fiber optic cable 16. Either way by determining the location of the microbend, it follows that this must be the location of the intrusion attempt.

Figure 4:
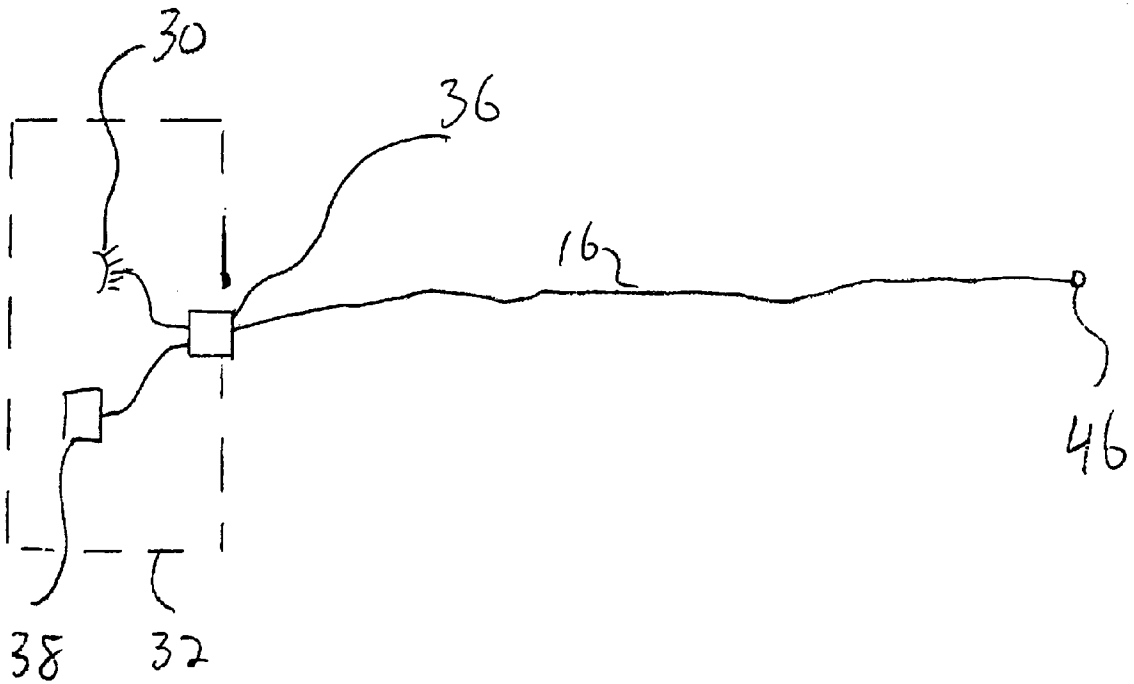
FIG. 4 shows a schematic diagram of a second embodiment of the intrusion detection system in accordance with the present invention.

Turning now to a control unit 17 of an alternative embodiment depicted in FIG. 4, there is shown the OTDR 32 as a stand alone intrusion detection and location system. As described above using OTDR technology, it is possible to determine backscattered light intensity along a fiber optic cable 16 at all points of distance.

Figure 5:
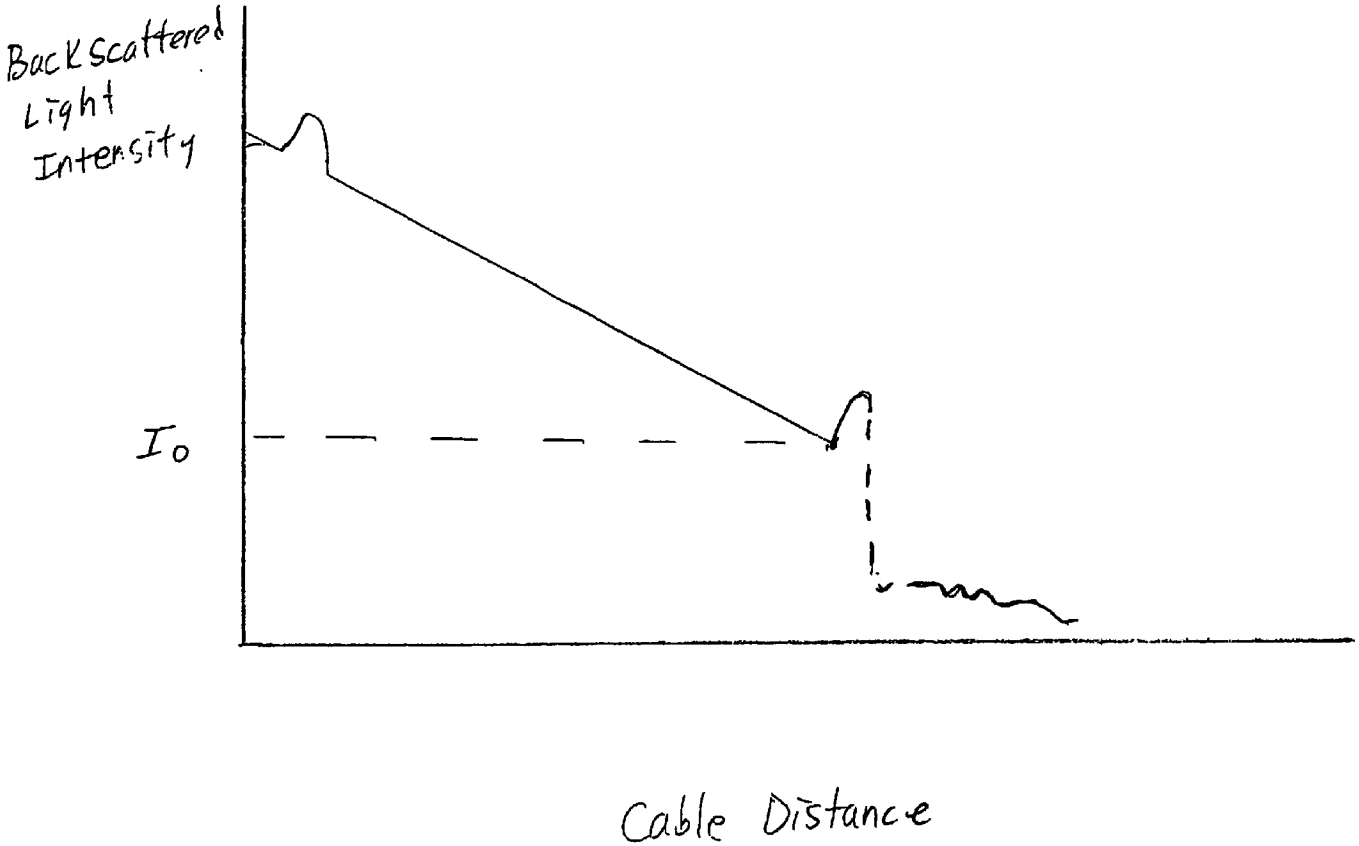
FIG. 5 is a graphic illustration of a typical backscattered light intensity versus cable length for a light pulse traveling down the intrusion detection system of FIG. 4.
Figure 6:
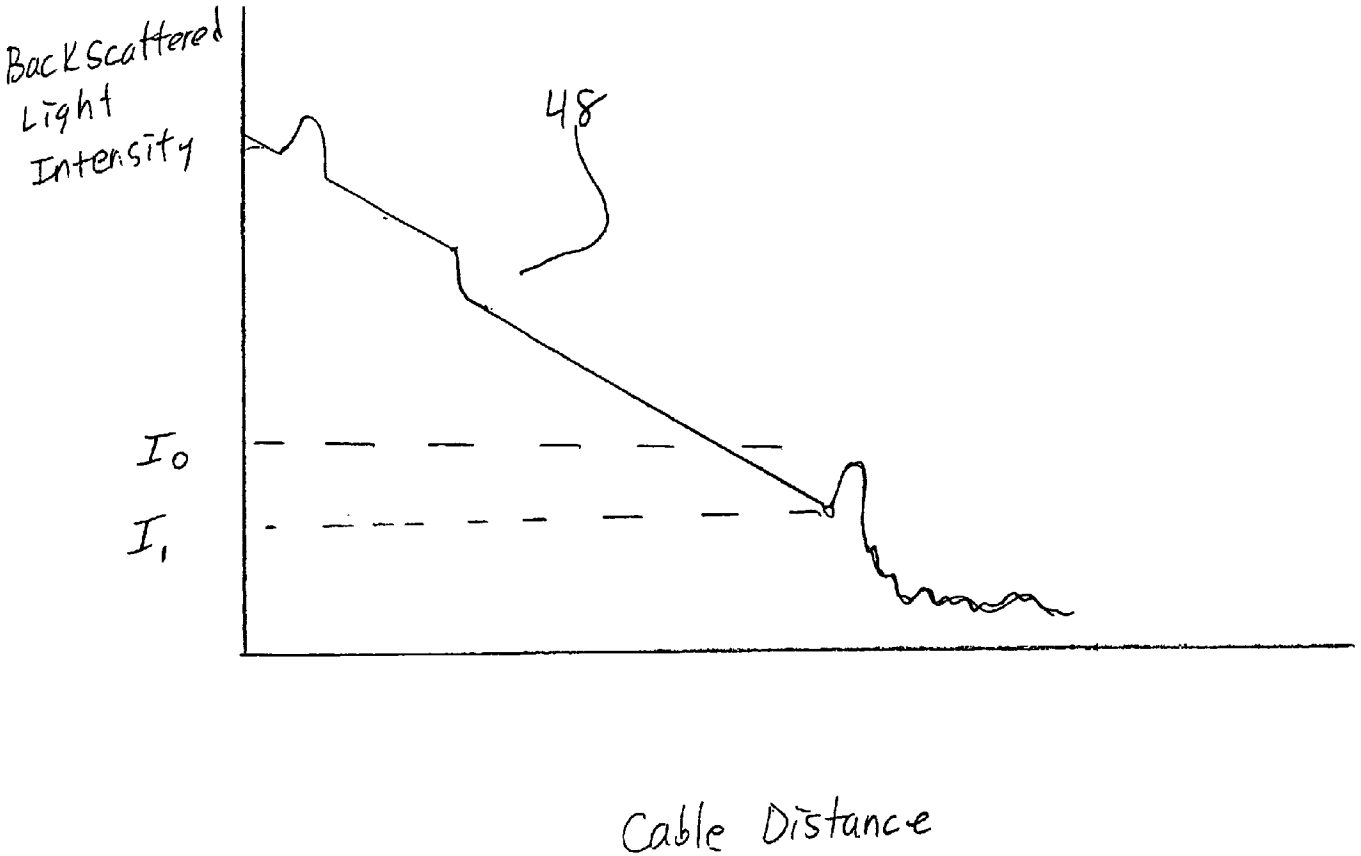
FIG. 6 is a graphic illustration of a typical backscattered light intensity versus cable length for a light pulse traveling down the intrusion detection system of FIG. 4 wherein there is a corruption in the cable.

Referring now to backscattering graphs depicted in FIGS. 5 and 6 the embodiment depicted in FIG. 4 shall now be described. The fiber optic cable 16 includes a second end 46 that causes a relatively high reflection of light. The OTDR 32 continuously tests for backscattered light intensity at all points along the fiber optic cable 16.

Where the fiber optic cable 16 has no microbends the backscattered light intensity at the second end 46 has a level of 1 sub 0, shown in FIG. 5. As described earlier, a microbend causes a drop in backscattered light. Therefore, when a fiber optic cable includes a microbend 48 the backscattered light intensity at the second end now has a level of 1 sub 1 which is less than 1 sub 0.

Once the OTDR 32 finds that there is a loss of backscattered light intensity at the second end 46, an alarm is triggered. The OTDR 32 senses the change in the level of backscattered light intensity at the second end 46 and now searches for the location of the microbend 48. The microbend 48 is readily determined by searching for surges in backscattered light intensity as shown shown in FIG. 6.

Figure 14:
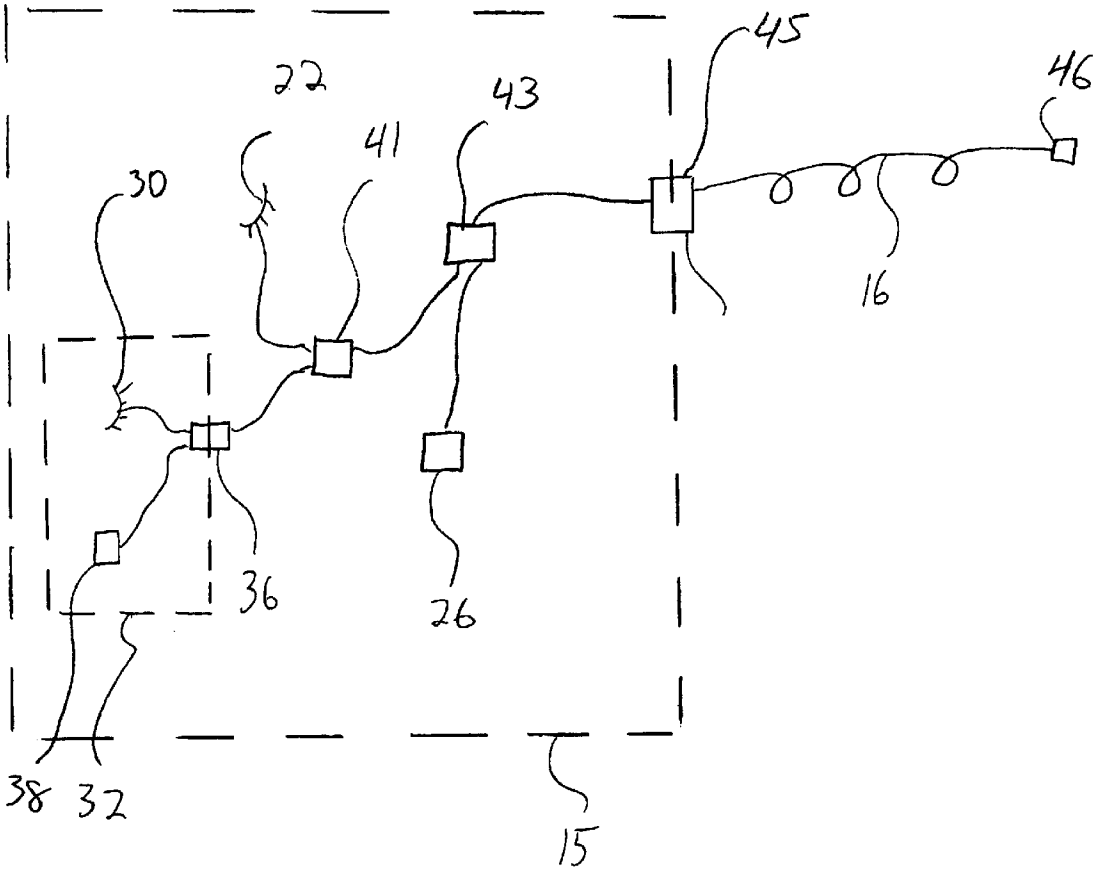
FIG. 14 is a schematic diagram of a second alternative embodiment of the intrusion detection system in accordance with the present invention.

Looking at a control unit 19 of yet another embodiment shown in FIG. 14, there is shown the first light source 22 transmitting light at a first frequency through couplers 41, 43 and 45 down the fiber optic cable 16. Backscattered light is continuously transmitted to the detector 26.

When the intensity of backscattered light from fiber optic cable end 46 falls below a threshold level, an alarm is triggered and the second light source 30 inside of the OTDR kicks on. The OTDR now searches for the intrusion location in the same manner as described above.

Fiber optic cables may be wrapped about the fence in a number of twists and turns to give varying degrees of perimeter intrusion detection. Alternatively, more than one fiberoptic cable can be used to also give varying degrees of perimeter intrusion detection. For each individual fiberoptic cable there must be a light source and a detector. Alternatively, an OTDR having an optical switcher can operate to monitor multiple fiber optic cables.

Figure 7:
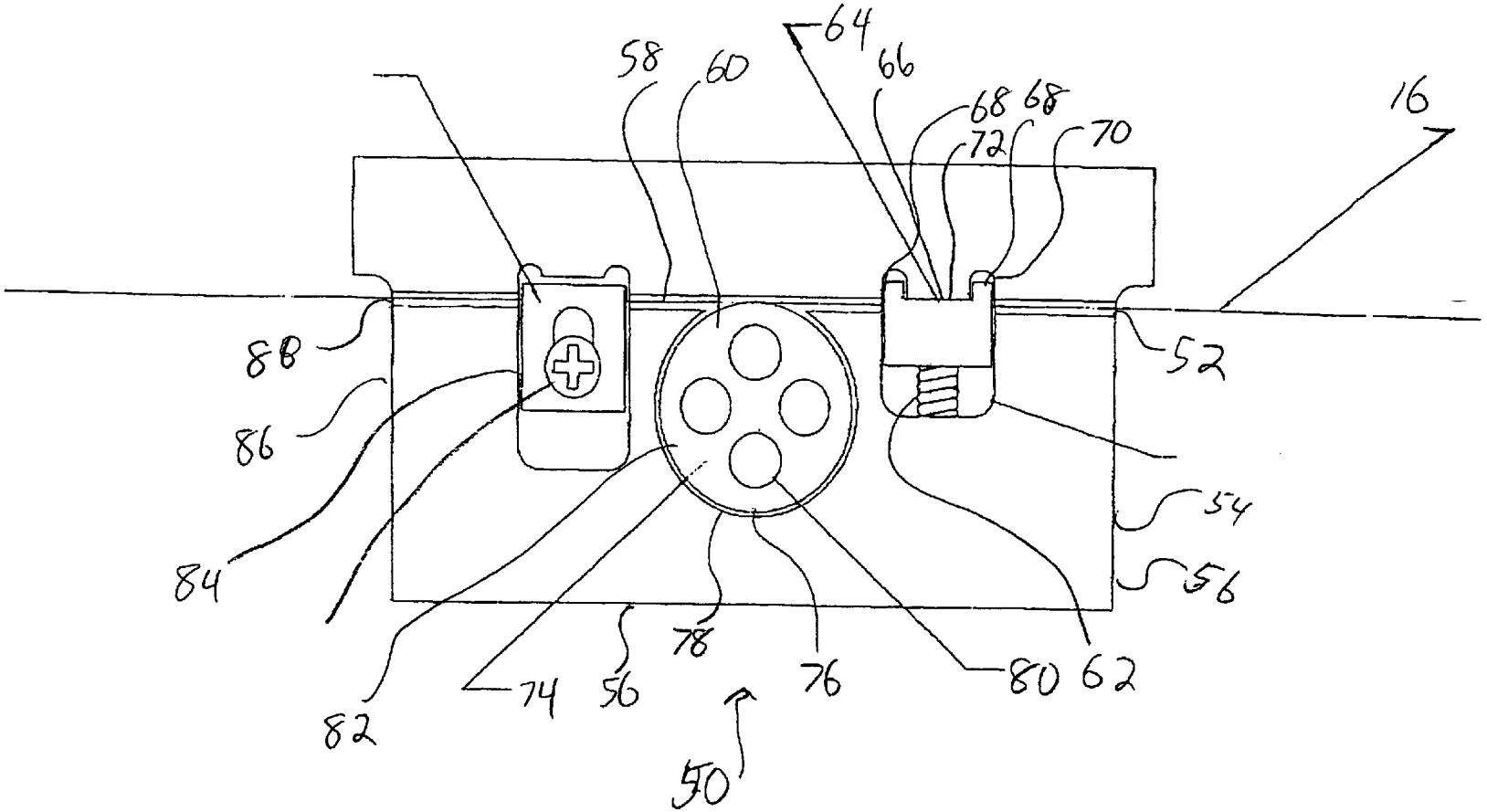
FIG. 7 is a cross sectional side view of a first embodiment of a mechanical attenuation device in accordance with the present invention.

In some intrusion situations it may be difficult to cause a microbend in a fiberoptic cable. Therefore, a mechanical attenuation device may be needed to transform an intrusion attempt into a microbend in the fiber optic cable. Turning now to FIG. 7, at predetermined intervals, such as every 100 meters, the fiber optic cable 16 runs through a mechanical attenuation device 50. For support purposes, the mechanical attenuation device 50 is secured to the fence support post 14.

The fence support post 14 is less likely to displace under a force than the links 20 of the chain fence. Further it is easier to wrap around the thicker uniform construction of a fence support post 14 than the links 20 of the chain fence. It is also possible to effectively install the mechanical attenuation device 50 across a link 20 or a number of links of the chain fence.

In FIG. 7 there is shown an interior cross-sectional view of a first embodiment of the mechanical attenuation device 50. The fiber optic cable 16 enters the device through an ingress opening 52 disposed on a first side 54 of a housing 56 of the mechanical attenuation device 50.

A portion 58 of the fiber optic cable 16 sits inside a cable tensioning well 60. A compression spring 62 forces a cable tensioner 64 to wedge the fiber optic cable 16 against an upper wall 66 of the cable tensioning well 60. A pair of cable tensioner shoulders 68 come to rest in shoulder sockets 70.

The fiber optic cable 16 runs through a channel disposed in each shoulder 70 and across the top 72 of cable tensioner 64. The fiber optic cable 16 is movably secured between the top 72 of the cable tensioner 64 and the upper wall 66 of the cable tensioning well 60.

In this manner the fiber optic cable 16 moves only by applying a predetermined minimum force along its longitudinal axis. Once the displacement force is released the fiber optic cable 16 becomes secured, once again, in its new location between to the top 72 of the cable tensioner 64 and the upper wall 66 of the cable tensioning well 60.

An attenuation well 74, preferably circular shape, disposed in the mechanical attenuation device housing 56 allows slack fiber optic cable 76 to be spooled against an inner circular wall 78 having a first radius.

A plurality of mandrels 80 are perpendicularly disposed from a back surface 82 of the attenuation well 74. The mandrels 80 force the fiber optic cable 76 spooled inside the attenuation well 74 to take on a circular shape defined by a second radius when a sufficient force is applied to the fiber optic cable 16 outside of the ingress opening 52.

A cable clamp 84 disposed near a second end 86 of the housing tightly secures a portion of the fiber optic cable 16 so that it remains stationary with respect to the housing 56. This is important because the slack fiber optic cable 76 in attenuation well might not achieve the smaller radius in response to a force if the cable 16 were allowed to slide at both the first 52 and second ends 86 of the housing 56.

The fiber optic cable 16 exits through the egress opening 88 disposed at a second end 86 of the housing 56. From the second end 86 the cable 16 is once again secured to the fence 12 until it reaches another mechanical attenuation device 50 at which the above structure and function repeats itself.

In use, a force applied on the fiber optic cable 16 at a position outside of the ingress opening 52 relative to the mechanical attenuation housing 50 causes displacement of the fiber optic cable 16. Inside the mechanical attenuation housing 50, the fiber optic cable 16 slides across the top 72 of the cable tensioner 64.

The cable clamp 84 prevents that portion of the fiber 16 from moving. Therefore, the circular shaped slack fiber 76 in the attenuation well 74 becomes smaller until it wraps around the plurality of mandrels 80.

At this time, a measurable attenuation is produced. As will be discussed later, this attenuation is measured by known means.

The present invention will now be described with respect to an embodiment depicted by FIG. 8. A mechanical attenuation device 90 includes a fiber ingress opening 92 at its first end 94 through which the fiber optic cable 16 is threaded. The fiber optic cable 16 is fixedly attached to a sliding trigger mechanism 96 disposed in the mechanical attenuation device 90.

The fiber optic cable 16 moves with the sliding trigger mechanism 96 when an external displacement force is provided to the fiber optic cable 16. A spring 98 disposed between an internal wall 100 and the sliding trigger mechanism 96 provides sensitivity so that the amount of displacement force required to move the sliding trigger mechanism 96 can be adjusted by using springs of varying strength. The spring 100 fits in a recess 102 of the sliding trigger mechanism 96.

At the second end 102 of the mechanical attenuation device 90 the fiber optic cable 16 is threaded through a fiber egress opening 104. Working back toward the ingress opening 92 the fiber optic cable 16 is affixed in position relative to the housing 106 of the mechanical attenuation device 90 by a stationary clamping mechanism 108. Disposed between the stationary clamping mechanism 108 and the sliding trigger mechanism 96, a slack fiber well 110 holds a slack loop 112 of fiber optic cable 16. The sliding trigger mechanism 96 includes an extending portion 114 which holds down a spring loaded plunger 116 inside of an attenuation well 118.

Figure 9:
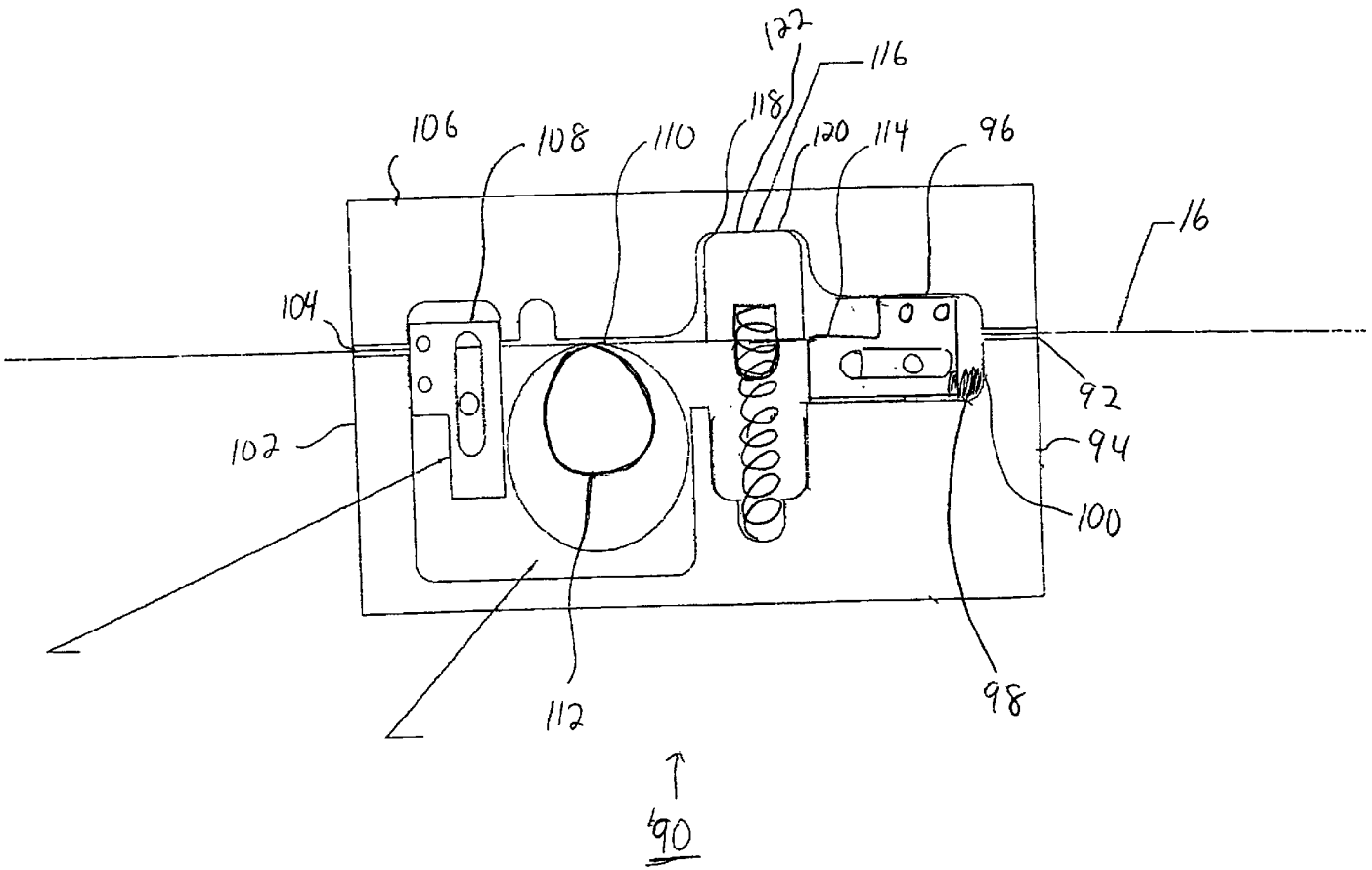
FIG. 9 is a cross sectional side view of the mechanical attenuation device of FIG. 8 in which there is a corruption to the fiber optic cable.

An external displacement force to the fiber optic cable 16 causes the sliding trigger mechanism 96 to move toward the ingress opening 92. As the extending portion 114 slides clear of the top of the spring loaded plunger 116, the spring loaded plunger 116 is released toward an upper interior wall 120 inside the housing 106. The fiber optic cable 16 becomes displaced by the spring loaded plunger 116 to an upper interior wall 120, thereby providing a microbend 122 in the fiber optic cable 16, shown in FIG. 9. As described earlier the microbend 122 provides a medium for a measurable attenuation of a light signal using OTDR technology.

Turning now to FIG. 14, there is shown an alternative embodiment of the mechanical attenuation device 90. The spring loaded plunger 116 has been replaced by an L-shaped plunger 167 having a plunger head 174 disposed from an L-shaped plunger arm 170. As the sliding trigger mechanism 96 slides over the top of the L-shaped plunger arm 170, the plunger head 174 is forced upward thereby causing the microbend 40 in the fiber optic cable 16. Is should now be apparent that a myriad of other internal designs of the mechanical attenuation device 90 could be effective in producing a microbend in response to a displacement force to the fiber optic cable 16.

Figure 10:
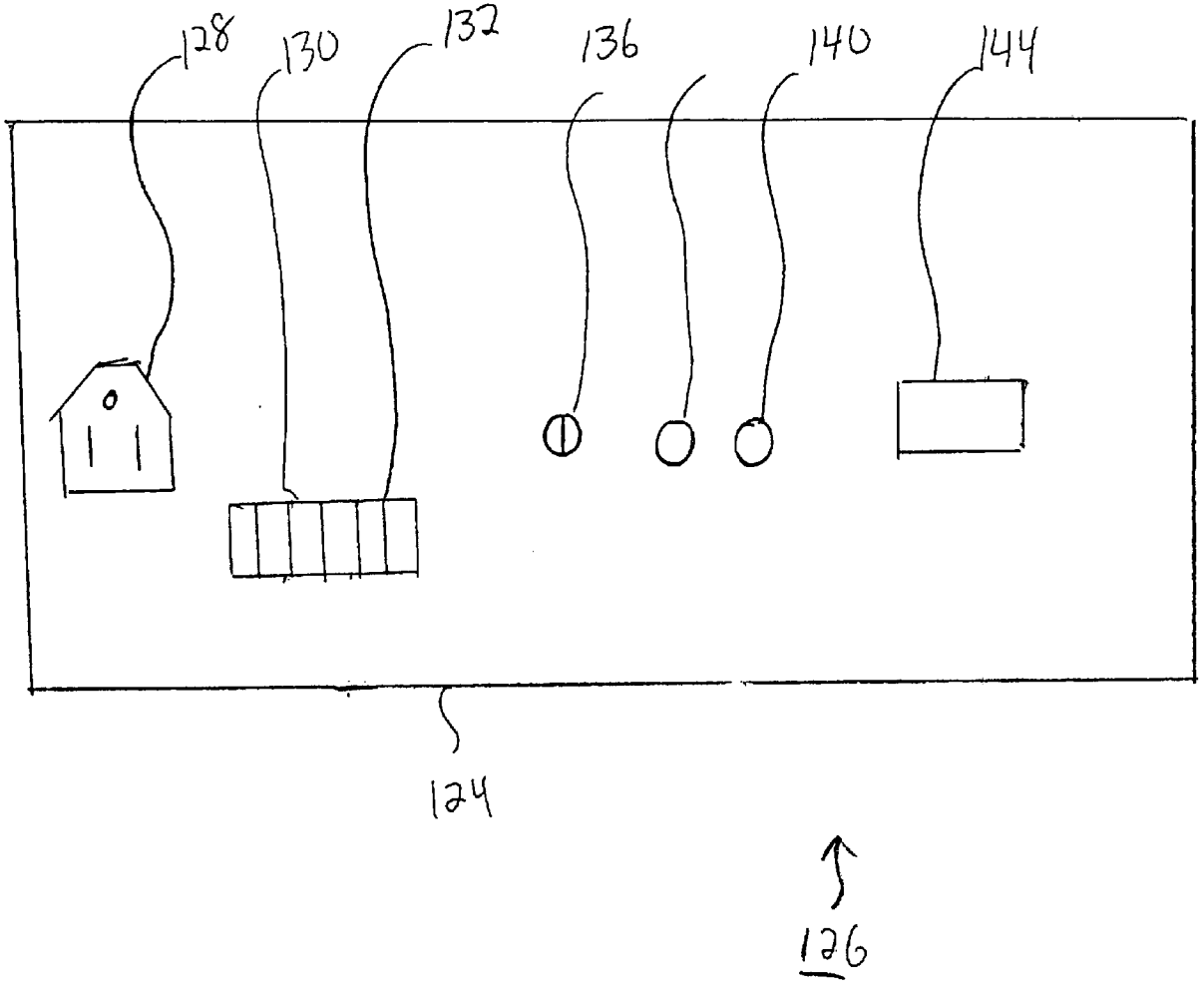
FIG. 10 is a backside view of a control panel in accordance with the present invention.
Figure 11:
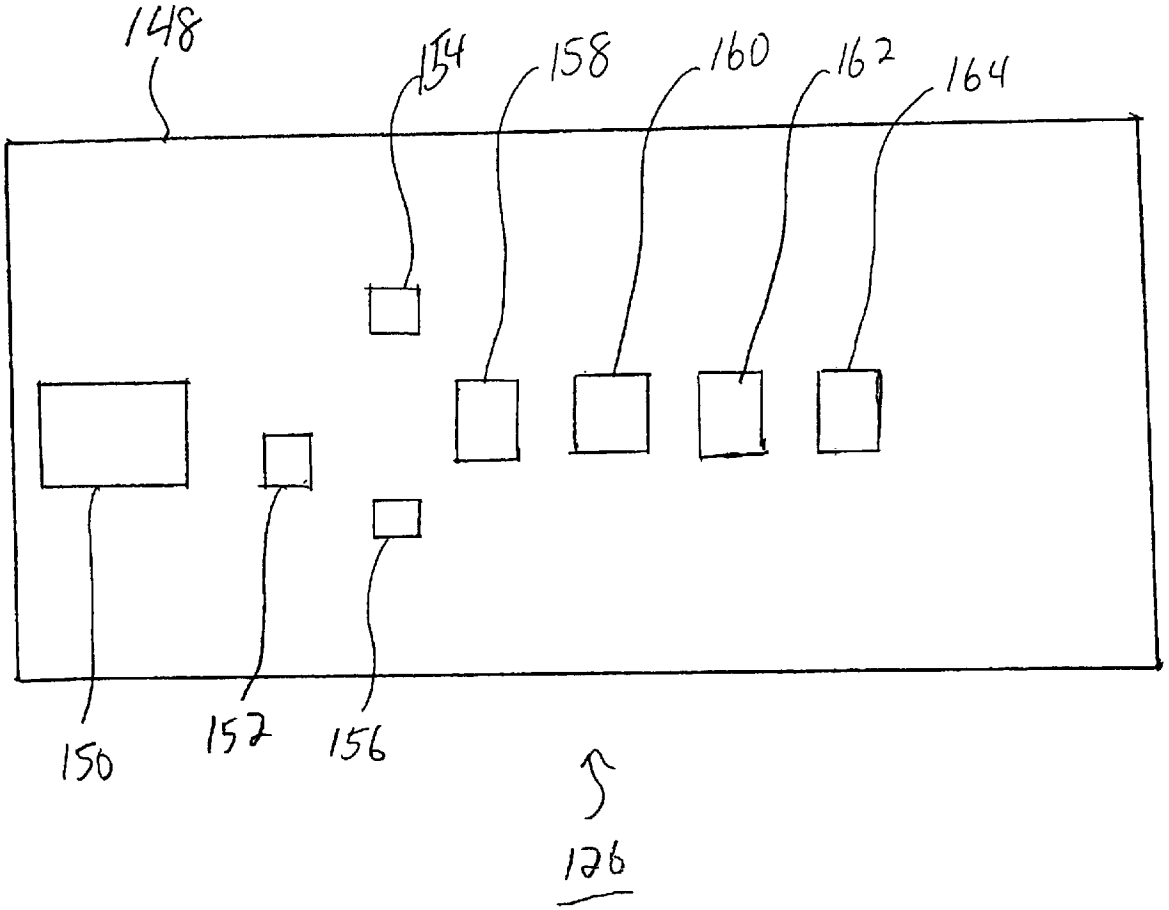
FIG. 11 is a front view of the control panel in accordance with the present invention.
Figure 13:
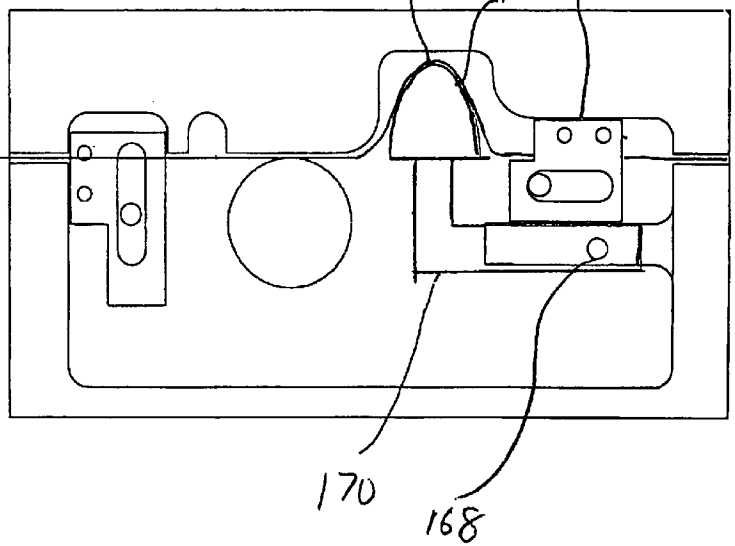
FIG. 13 is a cross sectional side view of the mechanical attenuation device of FIG. 12 in which there is a corruption to the fiber optic cable.
Figure 12:
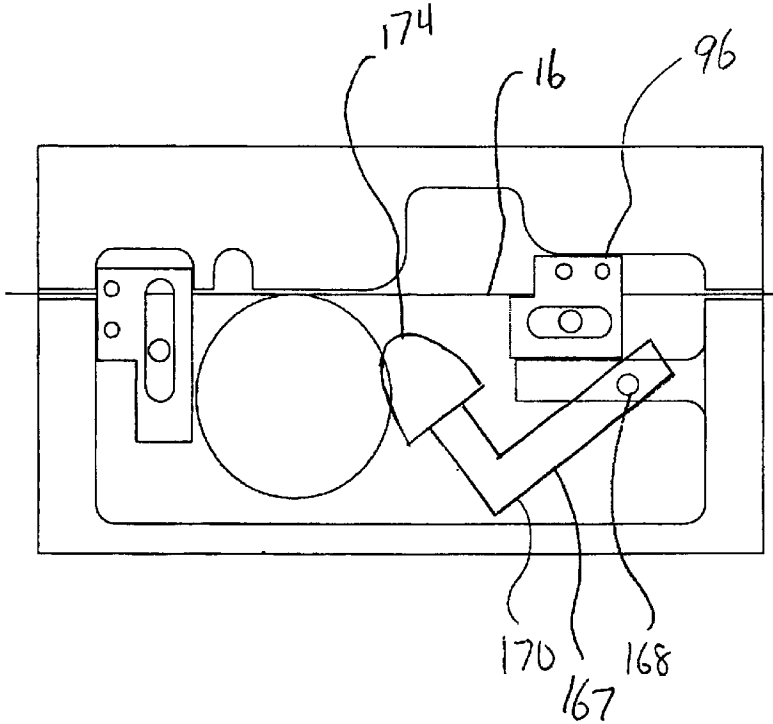
FIG. 12 is a cross sectional side view of an alternative embodiment of the mechanical attenuation device in accordance with the present invention.

Turning now to FIG. 10, there is shown a back side 124 of a control panel 126, of the present invention. Standard 110 volt single phase power is inputted into the control panel 126 through a power input female receptacle 128.

One relay pair 130 controls three pairs of contacts 132 to control external system devices, such as, perimeter lights and phone alarms (Not shown). For example, the first two contact pairs are open, thereby having the perimeter lights in an OFF state. When an intrusion is detected the relay pair 130 causes the contacts to close, thereby putting the perimeter lights to the ON state.

The third contact pair controls an audio and/or visual alarm. When an intrusion is detected, the relay changes the state of the third contact pair, thereby triggering the alarm system.

The intrusion detection sensitivity is adjusted by turning a sensitivity screw 136. In the embodiment depicted in FIG. 2, only the first end 37 of the fiber optic cable is coupled to a light source port 140. The light source emits a known quantity of light through the first end of the fiber optic cable 16 and transmitted light is returned to the light detector 28. The sensitivity is adjusted by altering the required intensity of transmitted light detected at the second end 46 of the fiber optic cable 16 to produce a positive intrusion detection.

For the embodiment depicted in FIG. 2 the cable is looped back to the control panel 126 so that light can be detected at the second end 28 as well as through backscattering means at the first end 2 of the cable 16. The sensitivity is adjusted by altering the level of received light that is required to produce a positive intrusion detection.

Cable data is continuously transmitted to a computer through a RS-232 serial port and interface 144. Computer software programs receive and manipulate this cable data. The computer allows a system operator to monitor the perimeter from a remote location.

A front panel 148 of the control panel 126 includes an LCD display 150, which displays the length of cable through which the emitted light has passed. In a typical example, the light source 22 emits a light pulse and then the detector 38 receives backscattered light at varying increments in time. The LCD display 150 shows the cable lengths at these small increments in time. When an attenuation of the light signal is detected, the OTDR 32 searches for the location of the microbend 48 and the display locks onto the length at the intrusion or microbend location.

Where no intrusion is detected, the control panel 126 continues such incremental testing until the length of the perimeter is reached. It should be noted that the units can be cascaded to provide an indefinite cable length. Further a fiber can be spiraled around a perimeter fence to provide different intrusion detection heights around the perimeter, while using only one control panel 126. Further, a multiplicity of cables can be installed to one control panel 126 wherein an optical switcher (Not shown) disposed in the control panel 126 allows for the monitoring of the light signal through the multiple cables.

An alarm LED 152 becomes illuminated when an intrusion is detected. A system ready LED 154 lets the user know that the control panel 126 has begun operation. A power display 156 illuminates when electric power is provided to the unit.

A mute switch 158 provides the ability to mute an alarm. A system test switch 160 provides the ability to simulate a break for purposes of testing how the control panel 126 responds to an intrusion.

A reset 162 functions in either the ENABLED state or DISABLED state. When the reset 162 is ENABLED, an alarm will cease when the intrusion detection condition is no longer detectable. In DISABLED state, the alarm continues upon an intrusion detection condition until the alarm is keyed to stop. Finally, a power switch 164 turns the unit on and off.

To manually test the operation of the system, a microbend causing displacement force is applied to the fiber optic cable 16. A system operator determines whether an intrusion is detected through the control panel. The system operator also checks each of the above described system functions.

To reset the mechanical attenuation devices 50 and 90, a technician dismantles the mechanical attenuator device housing. For the mechanical attenuation device of FIG. 7, the technician simply tugs the spooled fiber optic cable 76 so that it reloops into its original position inside the attenuation well 74. The fiber optic cable gently slides over the top 72 of the cable tensioner 64 into its original position and shape. At this point, the operator simply resets the control panel 126 so that it is in its original state.

Figure 8:
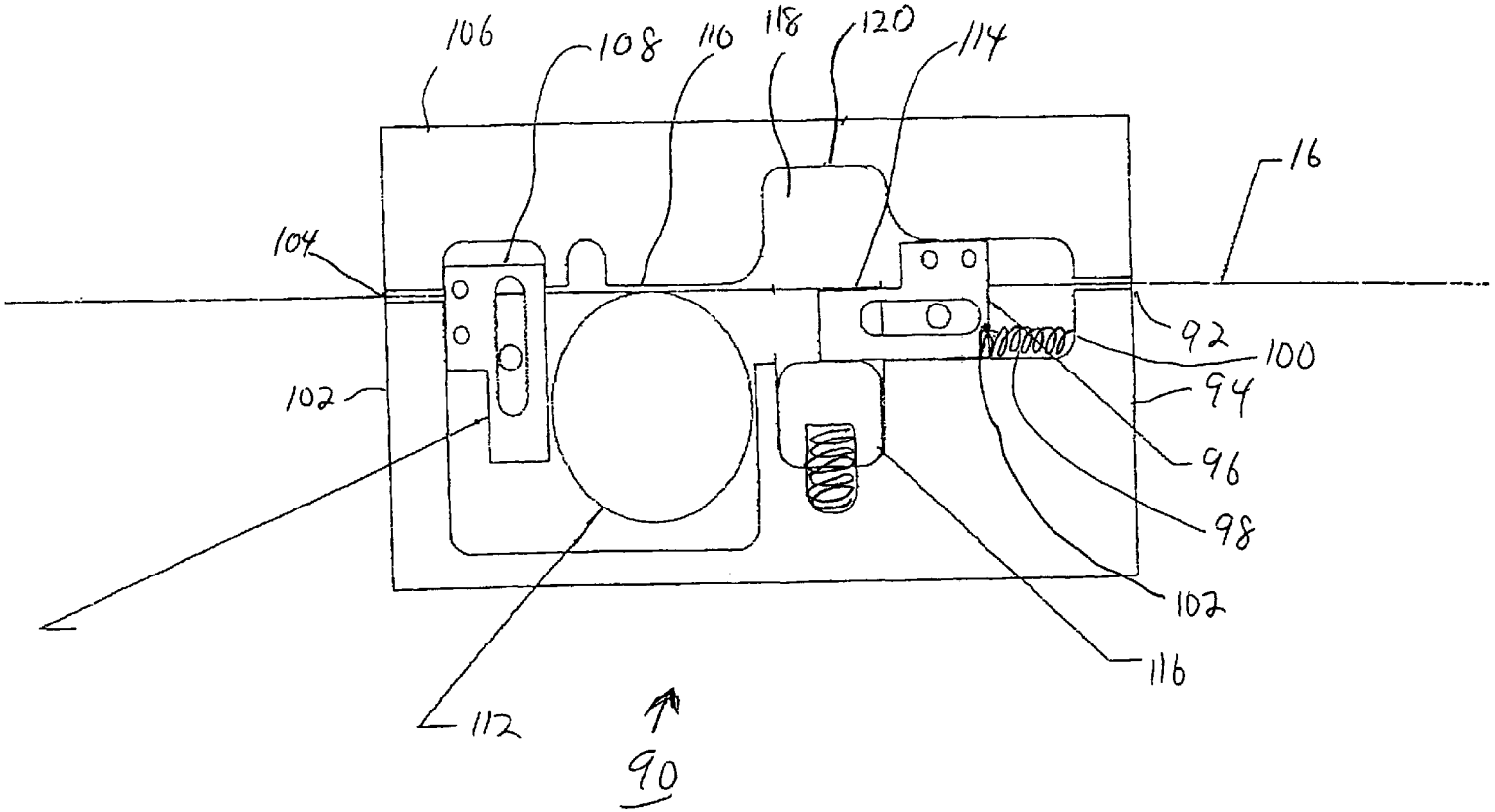
FIG. 8 is a cross sectional side view of a second embodiment of a mechanical attenuation device in accordance with the present invention.

To reset the mechanical attenuation device of FIG. 8, the technician first dismantles the mechanical attenuation device housing 106. Then the spring loaded plunger 116 is pushed back down. The sliding trigger mechanism 96 is pulled back over the top of the spring loaded plunger 116, and the fiber optic cable 16 is returned to its normal radius in the slack fiber well 110.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

12 Fence
14 Support posts
15 Control Unit
16 Fiber optic cable
17 Control Unit
18 Tie wrap
19 Control Unit
20 Fence links
22 First light source
24 One end of fiber optic cable
26 First photodetector
28 Second end of fiber optic cable
30 Second light source
32 OTDR
36 Coupler
37 First end of fiber optic cable
38 Second photodetector
39 Coupler
40 Dead zone
41 Coupler
42 Second surge
43 Coupler
44 Location of microbend
45 Coupler
46 Second end of cable
48 Microbend
50 Mechanical attenuation device 1
52 Ingress opening
54 First side
56 Housing
58 Portion of cable
60 Cable tensioning well
62 Compression spring
64 Cable tensioner
66 Upper wall
68 Shoulders
70 Sockets
72 Top of cable tensioner
74 Attenuation well
76 Spooled cable
78 Inner circular well
80 Mandrels
82 Back surface
84 Cable clamps
86 Second end
88 Egress opening
90 Mechanical attenuation device
92 Ingress opening
94 First end
96 Sliding trigger mechanism
98 Spring
100 Interior wall
102 Second end
104 Fiber egress opening
106 Housing
108 Stationary clamping mechanism
110 Slack fiber well
112 Slack loop
114 Extending portion
116 Spring loaded plunger
118 Attenuation well
120 Upper interior wall
124 Backside of control panel
126 Control panel
128 Female receptacle
130 Relay pair
132 Contacts
136 Sensitivity screw
140 Light source output
144 Rs-232 serial port and interface
148 Front panel
150 LCD display
152 Alarm led
154 System ready led
156 Power display
158 Mute switch
160 System test switch
162 Reset
164 Power switch
167 Plunger

168 Pivot
170 L-shaped plunger arm
174 Plunger head

What is claimed is:

1. An apparatus for producing a measurable attenuation to at least one light pulse through a fiber optic cable when said fiber optic cable is subjected to a displacement force, said apparatus comprising:

a housing having a cable ingress opening and a cable egress opening, said fiber optic cable inserted through said housing through said ingress opening and said egress opening;

securing means disposed within said housing for securing a portion of said fiber optic cable relative to a predetermined position within said housing;

movable securing means disposed within said housing, said movable securing means allowing a second portion of said fiber optic cable to displace relative to said housing when said fiber optic cable is subject to the displacement force; and light signal attenuation producing means disposed within said housing, said attenuation producing means being responsive to said displacement force, and producing an attenuation to said light pulse wherein said light signal attenuation producing means holds the attenuation even after the displacement force disappears.

2. The apparatus of claim 1, wherein said movable securing means includes a sliding mechanism fixedly secured to said fiber optic cable.

3. The apparatus of claim 2, wherein said sliding mechanism includes a lever being forced to a first position by a spring.

4. The apparatus of claim 2, wherein said light signal attenuation means includes a spring loaded plunger that is released to an attenuation position upon sufficient displacement of the sliding mechanism and does not automatically return to a non-attenuation position after the displacement force disappears.

5. The apparatus of claim 4, further including an attenuation well disposed within said housing such that when said spring loaded plunger is released into said attenuation well measurable attenuation occurs in said at least one light pulse.

6. The apparatus of claim 5 wherein said housing further includes a slack fiber well for storing a sufficient amount of slack fiber optic cable so that said fiber optic cable does not suffer structural failure upon release of said spring loaded plunger.

7. The apparatus of claim 1 wherein said movable securing means includes a tensioner which allows said fiber optic cable to move in only one direction when a displacement force is applied to said fiber optic cable.

8. The apparatus of claim 7 wherein said tensioner includes a compression spring that forces the fiber optic cable to be movably secured between the top of the tensioner and an interior wall of said housing.

9. The apparatus of claim 8 wherein said housing further includes an attenuation well for storing a length of slack fiber optic cable.

10. The apparatus of claim 9 wherein said slack fiber optic cable is caused to become taut in said attenuation well when a displacement force is applied to said fiber optic cable.

11. The apparatus of claim 10 wherein at least one mandrel is disposed in said attenuation well such that said fiber optic cable becomes taut against said at least one mandrel when a displacement force is applied to said fiber optic cable thereby causing a measurable attenuation in said at least one light pulse.

12. An intrusion detection and location apparatus for an area secured by at least one perimeter fence, said intrusion detection apparatus comprising:

at least one fiber optic cable secured to said perimeter fence;

light transmission means disposed at a first end of said at least one fiber optic cable for transmitting at least one light pulse from a light source through said at least one fiber optic cable;

light measuring means for measuring the intensity of light at a second end of said at least one fiber optic cable;

intrusion detecting means responsive to said light measuring means;

light backscatter measuring means responsive to said instrusion detection means for measuring the intensity of backscattered light from a second pulse of transmitted light that is the same or different than the at least one light pulse; and intrusion location means responsive to said light backscatter measuring means.

13. The apparatus of claim 12 further including automatic attenuation means which comprises a housing having a cable ingress opening and a cable egress opening, said fiber optic cable inserted through said housing through said ingress opening and said egress opening;

securing means disposed within said housing for securing a portion of said fiber optic cable relative to a predetermined position within said housing;

movable securing means disposed within said housing, said movable securing means allowing a second portion of said fiber optic cable to displace relative to said housing when said fiber optic cable is subject to a displacement force; and light signal attenuation producing means disposed within said housing, said attenuation producing means being responsive to said displacement force, and producing an attenuation to said light pulse wherein said light signal attenuation producing means holds the attenuation even after the displacement force disappears.

14. The apparatus of claim 13, wherein said movable securing means includes a sliding mechanism, said sliding mechanism fixedly secured to said fiber optic cable.

15. The apparatus of claim 14, wherein said sliding mechanism includes a lever being forced to a first position by a spring.

16. The apparatus of claim 14, wherein said cable attenuation means includes a spring loaded plunger that is released upon sufficient displacement of the sliding mechanism.

17. The apparatus of claim 16, further including an attenuation well disposed within said housing such that when said spring loaded plunger is released into said attenuation well measurable attenuation occurs in said at least one light pulse.

18. The apparatus of claim 17 wherein said housing further includes a slack fiber well for storing a sufficient amount of slack fiber optic cable so that said fiber optic cable does not suffer structural failure upon release of said spring loaded plunger.

19. The apparatus of claim 13 wherein said movable securing means includes a tensioner which allows said fiber optic cable to move in only one direction when a displacement force is applied to said fiber optic cable.

20. The apparatus of claim 19 wherein said tensioner includes a compression spring that forces the fiber optic cable to be movably secured between the top of the tensioner and an interior wall of said housing.

21. The apparatus of claim 20 wherein said housing further includes an attenuation well for storing a length of slack fiber optic cable.

22. The apparatus of claim 21 wherein said slack fiber optic cable is caused to become taut in said attenuation well when an external displacement force is applied to said fiber optic cable.

23. The apparatus of claim 20 wherein at least one mandrel is disposed in said attenuation well such that said fiber optic cable becomes taut against said at least one mandrel when a displacement force is applied to said fiber optic cable thereby causing a measurable attenuation in said at least one light pulse.

24. The apparatus of claim 12 further including alarm means responsive to said intrusion detection means.

25. The apparatus of claim 24 wherein said alarm means includes at least one audio alarm.

26. The apparatus of claim 24 wherein said alarm means includes at least one visual alarm.

27. The apparatus of claim 12 further including cable intrusion location display means responsive to said intrusion locations means.

28. The apparatus of claim 26 wherein said cable intrusion location display means includes a display housing having a light emitting diode or liquid crystal display.

29. An intrusion detection and location apparatus for an area secured by at least one perimeter fence, said intrusion detection apparatus comprising:

at least one fiber optic cable secured to said perimeter fence;

a first light transmission means disposed at a first end of said at least one fiber optic cable for transmitting at least one light pulse through said at least one fiber optic cable;

a first light measuring means for measuring the intensity of light at a second end of said at least one fiber optic cable;

intrusion detecting means responsive to said light measuring means;

a second light transmitting means responsive to said intrusion detecting means for transmitting at least a second pulse of light through said fiber optic cable;

light backscatter measuring means for measuring the intensity of backscattered light from said at least a second pulse of transmitted light; and intrusion location means responsive to said light backscatter measuring means.

30. The apparatus of claim 29, wherein said first measuring means includes a photodetector for receiving transmitted light at the second end of the fiber optic cable.

31. The apparatus of claim 29, wherein said first measuring means includes a photodetector for receiving backscattered light from the second end of the fiber optic cable.

32. The apparatus of claim 29 further including automatic attenuation means which comprises a housing having a cable ingress opening and a cable egress opening, said fiber optic cable inserted through said housing through said ingress opening and said egress opening;

securing means disposed within said housing for securing a portion of said fiber optic cable relative to a predetermined position within said housing;

movable securing means disposed within said housing, said movable securing means allowing a second portion of said fiber optic cable to displace relative to said housing when said fiber optic cable is subject to a displacement force; and light signal attenuation producing means disposed within said housing, said attenuation producing means being responsive to said displacement force, and producing an attenuation to said light pulse wherein said light signal attenuation producing means holds the attenuation even after the displacement force disappears.

33. The apparatus of claim 32, wherein said movable securing means includes a sliding mechanism, said sliding mechanism fixedly secured to said fiber optic cable.

34. The apparatus of claim 33, wherein said sliding mechanism includes a lever being forced to a first position by a spring.

35. The apparatus of claim 32, wherein said light signal attenuation means includes a spring loaded plunger that is released to an attenuation position upon sufficient displacement of the sliding mechanism and does not automatically return to a non-attenuation position after the displacement force disappears.

36. A method for detecting and locating an intrusion into an area having at least a portion bounded by a fence, said fence having at least one fiber optic cable secured thereto, said method comprising:

transmitting at least one pulse of light through a first end of said at least one fiber optic cable;

producing a known attenuation to a light signal through said at least one fiber optic cable in response to a force applied on said fiber optic cable:

measuring the intensity of said at least one pulse of light at a second end of the at least one fiber optic cable;

determining an intrusion responsive the measured intensity of said at least one pulse of light at the second end of the at least one fiber optic cable;

measuring the intensity of backscattered light at various locations along said at least one fiber optic cable; and determining an intrusion location responsive to the intensity of backscattered light at various locations along said at least one fiber optic cable.

37. A method for detecting and locating an intrusion into an area having at least a portion bounded by a fence, said fence having at least one fiber optic cable secured thereto, said method comprising:

transmitting at least one pulse of light through a first end of said at least one fiber optic cable;

producing a known attenuation to a light signal through said at least one fiber optic cable in response to a force applied on said fiber optic cable;

measuring the intensity of backscattered light from a second end of the at least one fiber optic cable;

determining an intrusion responsive to the detected intensity of backscattered light from said second end of the at least one fiber optic cable;

measuring the intensity of backscattered light at various locations along said at least one fiber optic cable; and determining an intrusion location responsive to the intensity of backscattered light at various locations along said at least one fiber optic cable.

* * * * *